United States Patent [19]

Franz

[11] Patent Number: 5,012,952

[45] Date of Patent: May 7, 1991

[54] LID AND CUP DISPENSER HAVING AN ELONGATED YIELDABLE TENSION ELEMENT SECURED BY A TRANSVERSELY ADJUSTABLE ANCHORING BLOCK DISPOSED ASTRIDE THE DISPENSING OPENING

[76] Inventor: Leo J. Franz, 3792 Hollow Tree La., Lilburn, Ga. 30247

[21] Appl. No.: 365,010

[22] Filed: Jun. 12, 1989

[51] Int. Cl.[5] ..... B65H 1/08; B65H 3/26; B65D 83/04

[52] U.S. Cl. ..... 221/36; 221/44; 221/59; 221/63; 221/221; 221/228; 221/240; 221/267; 221/304; 221/307; 312/43; 312/45

[58] Field of Search ..... 221/36, 44, 59, 63, 221/221, 224, 228, 240, 243, 244, 251, 267, 295, 303, 304, 307, 309, 311; 312/43, 45, 71

[56] References Cited

U.S. PATENT DOCUMENTS

| | | | |
|---|---|---|---|
| 2,232,425 | 2/1941 | Balton | 221/307 |
| 3,435,987 | 4/1969 | Saunders et al. | 221/304 X |
| 3,800,981 | 4/1974 | Zeller | 221/309 X |
| 4,234,101 | 11/1980 | Pastore | 221/304 X |
| 4,858,783 | 8/1989 | Mayfield | 221/59 |

*Primary Examiner*—Kevin P. Shaver
*Assistant Examiner*—Kenneth DeRosa
*Attorney, Agent, or Firm*—Rodgers & Rodgers

[57] ABSTRACT

A group of flanged lids or cups of substantially identical construction and arranged in nested relation in a container are dispensed from an open end of the container by an elongated yieldable tension element disposed astride the open end of the container and arranged to override the flange of the article adjacent the open end of the container thereby to release and to aid in ejecting the article from the container.

12 Claims, 2 Drawing Sheets

LID AND CUP DISPENSER HAVING AN ELONGATED YIELDABLE TENSION ELEMENT SECURED BY A TRANSVERSELY ADJUSTABLE ANCHORING BLOCK DISPOSED ASTRIDE THE DISPENSING OPENING

TECHNICAL FIELD

This invention relates to a dispenser for articles such as lids and cups disposed within a container and dislodged therefrom individually.

BACKGROUND ART

U.S. Pat. No. 3,861,563 issued Jan. 21, 1975 discloses an arrangement wherein articles to be dispensed are stacked within a tubular container and biased upwardly toward an overlying structure having downwardly extending projections which cause the uppermost article in the container to be tilted and thus rendered acceptable for removal from the container.

U.S. Pat. No. 4,243,153 issued Jan. 6, 1981 for a bowl and lid dispenser discloses an arrangement wherein a vertically stacked column of articles such as bowls or lids are biased upwardly by compression spring into an uppermost cavity from which the articles may be removed.

SUMMARY OF THE INVENTION

According to this invention in one form, an article is dispensed from a group of nested substantially identical flanged articles disposed in an elongated container and biased toward an open end of the container, by means comprising an elongated yieldable tension element disposed astride the open end of the container and in engagement with the flange of an article disposed at the open end of the container and normally holding such article against dislodgement from the container, the elongated yieldable tension element being adapted to override the flange of the adjacent article thereby to release and to aid in ejecting the article from the container.

BEST MODE OF CARRYING OUT THE INVENTION

Figure 1:
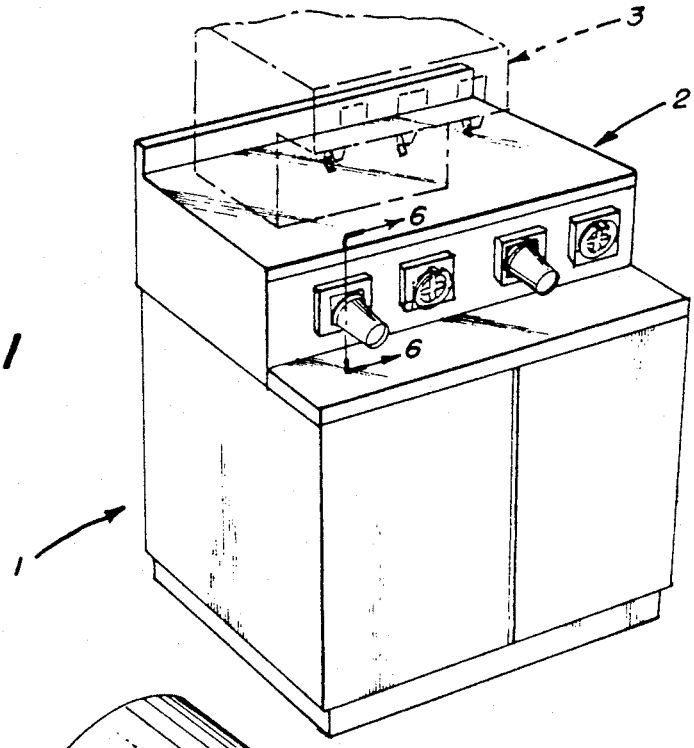
FIG. 1 is a perspective view of lid and cup dispensers mounted atop a supporting cabinet and atop which a soft drink dispenser is indicated in phantom lines.

With reference to FIG. 1, the numeral 1 generally designates a cabinet of some sort and the numeral 2 generally designates mechanism formed according to this invention for dispensing lids and cups and the numeral 3 designates a dispensing mechanism in phantom lines such as might be used for soft drinks and the like. Instead of arranging the dispensers as built-in parts of a cabinet, it may be desirable to arrange dispensers in a vertically stacked arrangement in a separate housing for mounting on a counter top.

Figure 2:
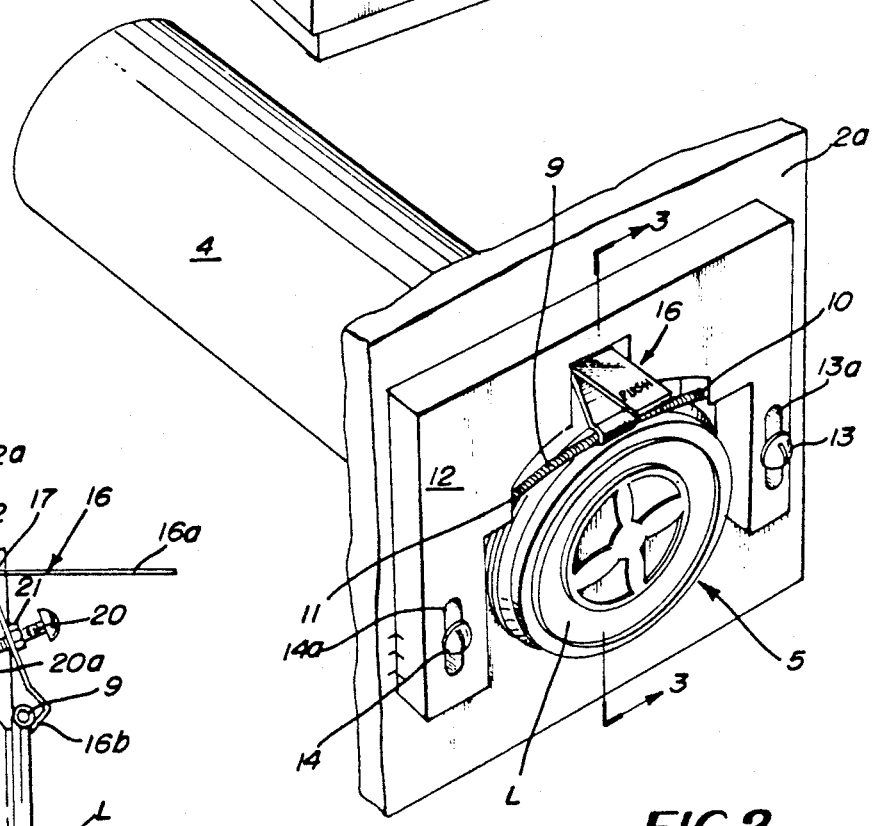
FIG. 2 is an enlarged perspective view of dispensing mechanisms such as are indicated generally in FIG. 1.
Figure 3:
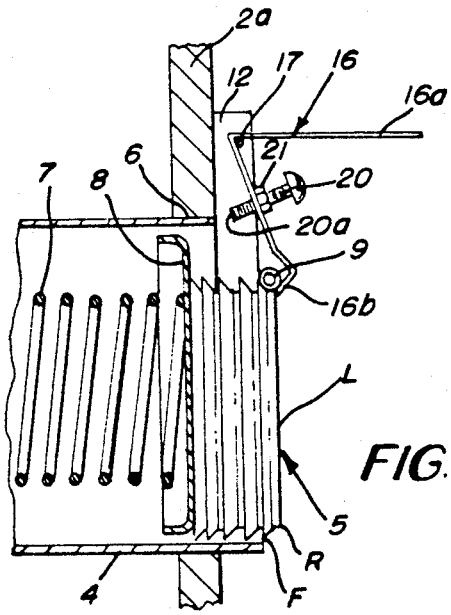
FIG. 3 is a cross sectional view taken along the line designated 3—3 in FIG. 2.

FIG. 2 shows an elongated container 4 in which a group of nested substantially identical flanged articles such as lids which group is generally designated by the numeral 5. Container 4 as shown in FIG. 3 is arranged with its near open end disposed in fixed coincidental relationship with an opening 6 formed in a wall 2*a* of housing 2. Each of the lids such as L includes a rim R and a flange F. The near open end of the container 4 is secured by any suitable means to the aperture 6 formed in the wall 2*a* of housing 2. Compression spring 7 imparts a force toward the right to the articles shown in FIGS. 3, 4, 5 and 6.

The force of spring 7 is applied to a dish shaped element 8 which engages the articles to be dispensed. For engaging and holding the articles within the dispensing device, an elongated yieldable tension element 9 is provided in accordance with a feature of this invention. This element preferably constitutes a tension spring whose ends are secured to securing elements 10 and 11 which are mounted to anchoring means 12 which in turn is adjustably secured to the wall 2*a* of housing 2 by means of screws 13 and 14 and their associated slots 13*a* and 14*a* respectively.

Figure 4:
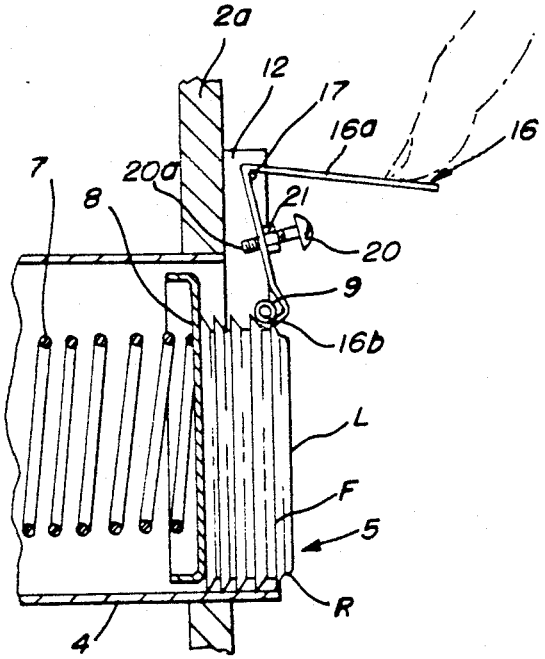
FIG. 4 is a view similar to FIG. 3 which shows the dispensing mechanism immediately prior to release and ejection of an article.

As is apparent particularly in FIGS. 3 and 4, the elongated yieldable tension element 9 is arranged in contact with the flange F of the lid L as best shown in FIG. 3. In this condition, the articles to be dispensed are secured against dispensation by the elongated yieldable tension element 9. While this element preferably constitutes a mechanical tension spring, some forms of this invention have been found feasible which utilize elongated yieldable elements formed of rubber and the like.

Figure 5:
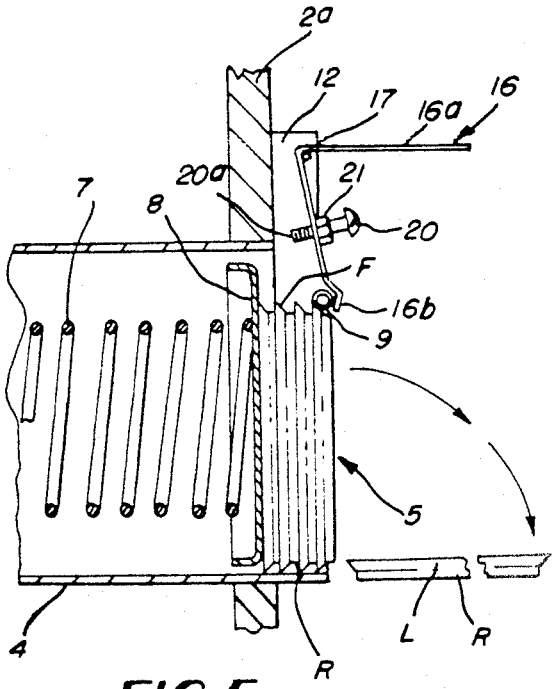
FIG. 5 is a view similar to FIG. 4 and shows the mechanism after an article has been ejected.

For the purpose of manipulating the elongated yieldable tension element 9 into dispensing position, a feeder element generally indicated at 16 is pivotally mounted about pin 17 and includes a manually engageable element 16*a* and a spring engaging element 16*b*. As is best shown in FIGS. 4 and 5, downward pressure manually applied to element 16*a* imparts clockwise rotation to feeder element 16 and causes the spring engaging part 16*b* to move the spring 9 over the flange F of the lid L as shown in FIG. 4. This action causes elongated yieldable tension element 9 to override the flange F and in turn due to a force to the right applied to flange F by spring 9 causes the lid L to fall into a catch box or the like from which it is easily removed.

In order to determine the magnitude of movement of the lid engaging part 16*b* of feeder element 16, a stroke adjusting element 20 in the form of a threaded, screw 20 and a lock nut 21 are provided. The left hand end 20*a* of screw 20 thus is engageable with the wall 2*a* of housing 2 so as to limit the movement from right to left of the lid engaging part 16*b* of feeder 16.

From the above description, it is apparent that the feeder element such as 16 is necessary for use in connection with lids because the lids are basically flat and do not provide a hand gripping surface.

Figure 6:
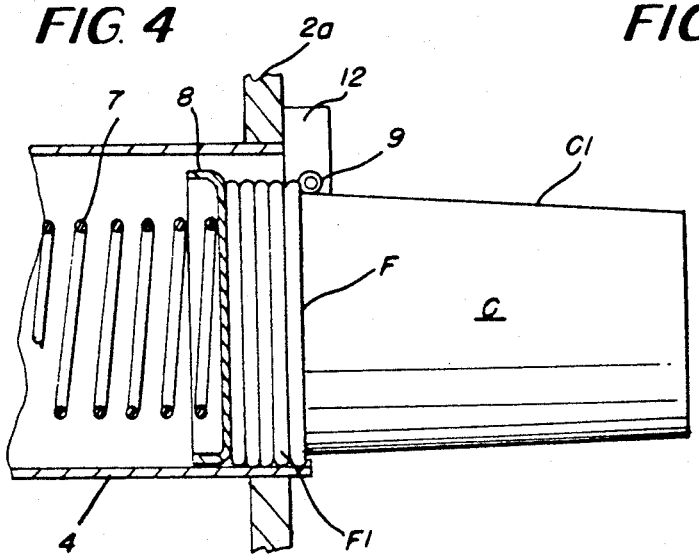
FIG. 6 is a view similar to FIGS. 3, 4 and 5 and shows the invention applied to cups rather than to lids.

The invention is not limited for use in conjunction with lids but is applicable also to cups such as are indicated at "C" in FIG. 6. When used in conjunction with cups, the elongated yieldable tension element 9 simply overrides the flange F of cup C and the cup C is removed by manually grasping the body portion Cl of cup C and by imparting a force to the right so as to remove the cup as is obvious. The spring 9 then engages the flange Fl of the immediately preceding cup so as to hold that cup against dislodgement.

From the description above, it is apparent that lids may be dispensed individually one at a time according to a feature of this invention. In the absence of suitable dispensing means such as is provided according to this invention, lids frequently as a matter of practice are simply stored in bulk in some sort of container. Since the lids are structurally identical they tend to nest and to cling together and are thus difficult to grasp one at a time. This fact leads to unsanitary handling and generally to inefficient utilization of lid space. As is generally indicated in FIG. 1, both cups and lids may be dispensed by devices which are disposed alongside each other and both of which embody principles of this invention.

I claim:

1. A device for dispensing an article from a group of nested substantially identical flanged articles disposed in an elongated container and biased toward and open end of said container, said device comprising an elongated yieldable tension element disposed astride said open end of said container and in engagement with the flange of an article disposed at said open end of said container and normally holding said article against dislodgement from said container, said elongated yieldable tension element being adapted to override said flange of said article thereby to release and to aid in ejecting said article from said container, and anchoring means disposed at said open end of said container and having securing means for respectively engaging and holding opposite ends of said elongated yieldable tension element so as to cause said elongated yieldable tension element to impart an inward force to said article, said anchoring means being bodily movable in a direction transverse to the axis of said container thereby to adapt the device for use with articles of different transverse dimensions.

2. A device according to claim 1 wherein the articles are biased toward the open end of said container by means of a compression spring disposed within said container.

3. A device according to claim 1 wherein the articles dispensed are lids for cups and the like.

4. A device according to claim 1 wherein said elongated yieldable tension element comprises a mechanical spring.

5. A device according to claim 1 wherein said elongated yieldable tension element effectively imparts an ejecting force to said one article when caused to override said flange of said article.

6. A device according to claim 5 wherein said elongated yieldable tension element immediately engages the flange of the article which immediately succeeds said one article thereby to hold such succeeding article against dislodgement from said container.

7. A device for dispensing an article from a group of nested substantially identical flanged articles disposed in an elongated container and biased toward an open end of said container, said device comprising an elongated yieldable tension element disposed astride said open end of said container and in engagement with the flange of an article disposed at said open end of said container and normally holding said article against dislodgement from said container, said elongated yieldable tension element being adapted to override said flange of said article thereby to release and to aid in ejecting said article from said container, and a feeder element engageable with said elongated yieldable tension element to impart overriding movement thereto.

8. A device according to claim 7 wherein said feeder element comprises a manually operable lever having a part engageable with said elongated yieldable tension element at a point thereon intermediate the ends thereof.

9. A device according to claim 7 wherein a stroke adjusting element is mounted on said feeder element.

10. A device for dispensing an article from a group of nested substantially identical flanged articles disposed in an elongated container and biased toward an open end of said container, said container being disposed within a housing with its open end aligned with and immediately adjacent an aperture in said housing, said device comprising an elongated yieldable tension element disposed astride said open end of said container and in engagement with the flange of an article disposed at said open end of said container and normally holding said article against dislodgement from said container, said elongated yieldable tension element being adapted to override said flange of said article thereby to release and to aid in ejecting said article from said container, anchoring means adjustably mounted on said housing, and a feeder element pivotally mounted on said anchoring means and having a manually engageable part and a part for engaging and moving said elongated yieldable tension means.

11. A device according to claim 10 wherein a stroke adjusting element is adjustably mounted on said feeder element.

12. A device according to claim 11 wherein said stroke adjusting element comprises an adjusting screw threadedly mounted on said feeder element.

* * * * *